US011232667B2

(12) United States Patent
Roodenburg et al.

(10) Patent No.: US 11,232,667 B2
(45) Date of Patent: Jan. 25, 2022

(54) COIN DISPENSER

(71) Applicant: Suzo International (Nederland) B.V., Oud-Beijerland (NL)

(72) Inventors: Edwin Andre Roodenburg, Krimpen A/D Ijssel (NL); Dennis Verhaar, The Hague (NL)

(73) Assignee: SUZO INTERNATIONAL (NEDERLAND) B.V., Oud-Beijerland (NL)

( * ) Notice: Subject to any disclaimer, the term of this patent is extended or adjusted under 35 U.S.C. 154(b) by 98 days.

(21) Appl. No.: 16/474,184

(22) PCT Filed: Dec. 20, 2017

(86) PCT No.: PCT/NL2017/050859
§ 371 (c)(1),
(2) Date: Jun. 27, 2019

(87) PCT Pub. No.: WO2018/124879
PCT Pub. Date: Jul. 5, 2018

(65) Prior Publication Data

US 2019/0347887 A1 Nov. 14, 2019

(30) Foreign Application Priority Data

Dec. 28, 2016 (NL) ..... 2018089

(51) Int. Cl.
*G07D 1/00* (2006.01)

(52) U.S. Cl.
CPC ..... *G07D 1/00* (2013.01)

(58) Field of Classification Search
CPC .. G07D 1/00; G07D 1/02; G07D 3/02; G07D 3/06
See application file for complete search history.

(56) References Cited

U.S. PATENT DOCUMENTS 1,794,925 A 3/1931 Sharp
3,768,616 A * 10/1973 Dykehouse ..... G07D 1/04 194/206

(Continued)

FOREIGN PATENT DOCUMENTS

| | | | |
|---|---|---|---|
| EP | 1302909 | A1 | 4/2003 |
| EP | 2538391 | A1 | 12/2012 |
| GB | 2335775 | A | 9/1999 |

*Primary Examiner* — Daniel I Walsh
(74) *Attorney, Agent, or Firm* — Browdy and Neimark, P.L.L.C.

(57) ABSTRACT

A coin dispenser dispenses coins having plural coin diameters ranging from a smallest coin diameter to a largest coin diameter. The coin dispenser comprises: a plurality of coin tubes, each coin tube being configured to hold a stack of coins having a same coin diameter, a base plate arranged under the coin tubes, the base plate forming support area's for supporting the stacks of coins held by the coin tubes, the base plate having dispensing edges each forming an edge of the base plate, each dispensing edge associated with a respective coin tube and being spaced apart, in a respective dispensing direction, from the support area of that coin tube, and a plurality of actuators, each actuator associated with a respective coin tube and configured to push the coin at the lowest position in the respective stack of coins held by the coin tube in the respective dispensing direction from the support area to an over the respective dispensing edge. The dispensing edges each comprise a centre edge part and two peripheral edge parts, the centre edge parts extending along the plane of the base plate in a direction perpendicular to the respective dispensing direction over a width equal to or less than the smallest coin diameter. The peripheral edge parts are adjacent to the ends of the centre edge part and extending along the plane of the base plate, the peripheral edge parts diverging in the dispensing direction whereby a width between the peripheral edge parts perpendicular to the (Continued)

dispensing direction increases, as seen in the dispensing direction, from equal to or less than the smallest coin diameter at the centre edge part to equal to or larger than the largest coin diameter.

15 Claims, 10 Drawing Sheets

(56) References Cited

U.S. PATENT DOCUMENTS 3,814,115 A * 6/1974 Van Acker ..... G07F 5/24 453/41
4,047,538 A * 9/1977 Sahni ..... G07D 1/00 453/40
4,221,227 A * 9/1980 Heiman ..... G07D 1/00 453/44
4,250,905 A * 2/1981 Kobayashi ..... G07D 1/00 221/125
4,257,436 A * 3/1981 Smith ..... G07D 1/00 453/41
4,266,564 A * 5/1981 Coburn ..... G07D 1/00 221/274
4,361,162 A * 11/1982 Brisebarre ..... G07D 1/00 453/20
4,367,760 A * 1/1983 Thomas ..... G07D 1/00 453/41
4,374,529 A * 2/1983 Kobayashi ..... G07D 1/00 221/11
4,427,389 A * 1/1984 D'Andrade ..... A63H 33/30 434/110
4,593,709 A * 6/1986 Duplessy ..... G07D 1/08 453/31
5,827,117 A * 10/1998 Naas ..... G07D 3/06 453/9
5,902,178 A * 5/1999 Perkitny ..... G07D 9/008 453/9
6,261,169 B1 * 7/2001 Ishida ..... G07D 1/02 194/350
7,048,623 B2 * 5/2006 Perkitny ..... G07D 3/00 194/334
2002/0115403 A1 * 8/2002 Adams ..... G07D 1/00 453/21
2002/0115404 A1 * 8/2002 Adams ..... G07D 1/00 453/21
2002/0187740 A1 * 12/2002 Perkitny ..... G07D 9/008 453/6
2002/0187741 A1 * 12/2002 Hunt-Vincent ..... G07D 1/00 453/18
2003/0013403 A1 * 1/2003 Blake ..... G07D 9/002 453/60
2005/0016814 A1 * 1/2005 McGunn ..... G07D 1/00 194/216
2005/0118941 A1 * 6/2005 Navis ..... G07D 1/00 453/16
2005/0126960 A1 * 6/2005 Aas ..... G07D 11/50 209/534
2007/0193851 A1 * 8/2007 Hanus ..... G07D 9/008 194/346
2008/0070490 A1 * 3/2008 Perkitny ..... G07D 3/00 453/61
2011/0076930 A1 * 3/2011 Chang ..... G07D 1/00 453/18
2019/0347887 A1 * 11/2019 Roodenburg ..... G07D 1/00
2021/0082223 A1 * 3/2021 Cohrs ..... G07D 1/00

* cited by examiner

COIN DISPENSER

The present invention relates to a coin dispenser, a coin handler comprising such coin dispenser and a use thereof.

A coin dispenser is a device configured to dispense coins. For example, coins may be dispensed as exchange money. The coin dispenser may be configured to dispense coins of different denominations, hence having different size, weight, thickness, material, etc. Furthermore, different currencies in different countries each have their own coin types, resulting in differences in weight, size, thickness, material, etc. per country.

For example US2007/0193851 discloses a rotatable coin magazine having plural coin channels. The channels are differently sized for holding different coin denominations. Each channel is provided with a discharge opening at a bottom of the channel. The discharging openings are generally rearward facing as seen in a counter clockwise direction of rotation of the magazine. The coins in the coin channel are supported by a magazine base member that forms partial floors in each channel. The base member is provided with arcuate slots at each channel. The slots are formed along a circular path. A coin ejector is provided having a pin received in the arcuate slot. Rotating the coin magazine will position the coin magazine so that a desired coin denomination can be pushed by the pin from the appropriate coin channel. The coin is thereby pushed over an arcuate edge of the partial floor formed by a part of the base member. Given the different coin diameters associated with the different coin denominations, the channels and the partial floor members are differently sized.

A problem associated with the coin magazine as disclosed in US2007/0193851 is that each channel needs to be specifically adapted for a particular coin diameter. Hence, when using the coin magazine (e.g. in another country) with another currency, another version of the coin magazine is required. Even more, when aiming to assign a different denomination to a particular channel, a different magazine having correspondingly changed diameters would need to be fitted.

The invention aims to provide a coin dispenser which is able to handle a variety of coin denominations while having a lower need for adaptations specific for the coin denominations.

According to an aspect of the invention, there is provided a coin dispenser for dispensing coins having plural coin diameters, each coin diameter being associated with a coin denomination, the coin diameters ranging from a smallest coin diameter to a largest coin diameter, the coin dispenser comprising:

- plural coin tubes, each coin tube being configured to hold a stack of coins having one of the plural coin diameters,
- a base plate arranged under the coin tubes, the base plate having a top surface that defines a plane, the top surface forming support area's for supporting the stacks of coins held by the coin tubes, the base plate having dispensing edges, each dispensing edge forming an edge of the base plate, each dispensing edge being associated with a respective coin tube and being spaced apart, in a respective dispensing direction, from the support area of that coin tube,
- a plurality of actuators, each actuator being associated with a respective coin tube and configured to push a coin resting on the support area associated with the respective coin tube in the respective dispensing direction from the support area to and over the dispensing edge associated with the respective coin tube, whereby the dispensing edges each comprise a centre edge part and two peripheral edge parts, the centre edge parts extending along the plane of the base plate in a direction perpendicular to the respective dispensing direction over a width equal to or less than the smallest coin diameter, the peripheral edge parts extending along the plane of the base plate, the peripheral edge parts diverging in the dispensing direction whereby a width between the peripheral edge parts perpendicular to the dispensing direction increases, as seen in the dispensing direction, from a width equal to or less than the smallest coin diameter at the centre edge part to a width equal to or larger than the largest coin diameter.

The coin dispenser is arranged to dispense coins of different denominations. Each denomination is stacked in a respective coin tube. The coin tubes are, at a bottom side thereof, accompanied by a support plate which supports the coins in the coin tube, i.e. forms a bottom of the coin tubes. At a lower side of the coin tubes, an exit opening is provided allowing a lowest one of the stack of coins held by the coin tube, to be moved from the stack of coins to a dispensing edge. An actuator moves the lowest coin from the stack to the dispensing edge and over the dispensing edge, where the coin falls into a dispensing outlet, for example into a dispensing area, a dispensing holder, etc. where for example a person can collect the dispensed coins.

The actuator moves the coin towards the dispensing edge, resulting in a part of the coin to reach over the edge. The further the coin is moved by the actuator, the larger the part of the coin that reaches over the dispensing edge. At a certain moment, gravity will cause the coin to fall over the dispensing edge. As a result of the differences in diameters of the different denominations, a larger diameter coin will be pushed more forwardly than a small diameter coin, or that a small coin would not even fall over the edge at all, when making use of a same actuator which pushes against a trailing edge of the coin as seen in a dispensing direction. In order to prevent that a larger diameter coin would fall over the dispensing edge at an earlier moment than a small coin, the following shape of the dispensing edge has been devised. The dispensing edge is formed by a centre edge part which is substantially perpendicular to the dispensing direction, and which extends over, at maximum, a distance equal to the diameter of the smallest ones of the coins. Assuming for the sake of explanation that the centre edge part extends over a distance equal to the smallest coin diameter, the coins with the smallest coin diameter will fall over the centre edge part, i.e. will fall when the coin has been pushed forwardly to cause (at least) half of the coin to reach over the centre edge part. At both ends of the centre edge part, the dispensing edge further extends under a diverging angle, in the plane of the support plate, the edges for example extend forwardly at an angle in a range of 35-50 degrees, preferably 40-50 degrees, more preferably 45 degrees in respect of the discharging direction. As a result of the diverging angle, the width between the forwardly extending part of the dispensing edge increases in the dispensing direction. The larger the coin diameter, the more the middle of the coin is to be pushed forwardly to cause the coin to fall, as the opening between the peripheral dispensing edge parts increases in the dispensing direction. As the peripheral parts of the dispensing edges are arranged under an angle in respect of the dispensing direction, the position where the centre of the coin is to be at the moment when the coin starts to fall over the dispensing edge, will move forward with the diameter of the coin, causing that the moment where the coin starts to fall over the dispensing edge, will, for different coin diameters, take place when the trailing edge of the coin, against which the actuator may push, is at substantially a same position for each of the coin diameters. Thus, substantially independently of coin diameter, the falling of the coin over the edge will start at a same position of the trailing edge of the coin (as seen in the dispensing direction). Hence, the dispensing edges for all coin denominations may be provided with a same shape, obviating a need to specifically adapt either the dispensing edge of the actuator range of movement to the specific coin diameter. Thus, a same dispensing edge and actuator may be applied for all coin denominations.

Plural coin tubes, actuators and dispensing edges may be provided, each assembly of coin tube, actuator and dispensing edge for a particular coin diameter. As explained above, the dispensing edge and the actuator may be held the same for all coin denominations. As a result, only the coin tube diameter would need to be adapted specifically for the respective coin diameter.

The actuators may comprise pushers having a range of movement to push the lowest coin in the stack of coins in the coin tube from the stack to the dispensing edge The actuator may for example push against a back side edge, i.e. trailing edge, of the coin (seen in the discharging direction). The term discharging direction may be understood as a horizontal direction over the base plate from the lowest coin in the coin tube to the dispensing edge. The coin tube may be understood as a holder, such as a vertically oriented holder, that holds a vertically stacked plurality of (each horizontally placed) coins. At lower side of the coin tube, i.e. above the base plate, an opening is provided to allow a lowest one of the coins of the stack to be pushed away from the lowest position in the stack to the dispensing edge. The base plate may be formed by a single, horizontal plate on which all the coin tubes are arranged and which forms support area's for each of the stacks of coins in the coin tubes. Also, the base plate may form a sliding surface over which the coins are pushed by the actuators towards the dispensing edges. The coin denominations may be understood as different coin values, which are accompanied by differences in one or more of coin diameter, coin thickness, coin material, image depicted by the coin relief, etc. In particular, in the present case, the different coin denominations are considered to relate to different coin diameters.

In an embodiment, each actuator is configured to move a respective one of the coins along a trajectory in the dispensing direction, a length of the trajectory of each actuator being the same for each coin diameter (and thus irrespective of the coin diameter). As explained above, for each con denomination, the position of the trailing edge of the coin, at the moment when the coin starts to fall over the coin dispensing edge, is substantially the same, irrespective of coin denomination/diameter. As a result, a similar pusher, i.e. a pusher (actuator) having a similar range of movement, may be applied for each of the diameters, thus obviating the need for specific actuators per coin diameter.

In an embodiment, a dimensioning of all dispensing edges is the same, irrespective of coin denomination (and thus irrespective of the coin diameter). As explained above, for each coin denomination, the position of the trailing edge of each coin, at the moment when the coin starts to fall over the coin dispensing edge, is substantially the same, irrespective of coin denomination/diameter. As a result, a similar coin dispensing edge shape may be applied for each of the diameters, thus obviating the need for specific edge designs or edge positions per coin diameter.

In an embodiment, the width along which the centre edge part extends in the direction perpendicular to the dispensing direction equals the smallest coin diameter and the maximum width between the peripheral edge parts in the direction perpendicular to the dispensing direction equals the largest coin diameter. As a result, in line with the above explanation, from the smallest to the largest coin diameter, the falling behaviour when the coin starts to fall over the dispensing edge, will be the same—i.e. the position of the trailing edge of the coin at the moment when the coin starts to fall, will be the same, causing that the moment when the coins starts to fall, when pushed by a similar actuator, will be the same.

In an embodiment, the actuator comprises a rotatable part which is rotatable about an axis perpendicular to the plane of the base plate, the rotatable part comprising a pusher extending in vertical direction from the plane of the base plate and an arm extending between the axis of rotation and the pusher, a rotation of the rotatable part causing the pusher to push against the coin resting on the support area of the respective coin tube, i.e. the coin at the lowest position of the respective stack of coins. A mechanically reliable configuration may be provided by a rotatable part, as it may minimize a number of moving parts and simplify a mechanical construction of the actuator. The rotatable part may comprise a rotatable disk (forming the arm) arranged in a plane of the base plate and having a vertically extending pin, to bear against a trailing edge of the coin. The axis of rotation of the rotatable part may be positioned, in respect of a discharging path defined by the discharging direction, offset from the discharging path. The offset may be substantially the same as the radius from the vertically extending pin to the axis, so that the vertically oriented pin pushes against approximately a centre of the coin. During the rotation of the rotatable part, the point of contact will move somewhat (as the discharging path may be a substantially straight line while the rotatable part rotates and hence the pin about the axis). The rotatable disk may have a diameter larger than a diameter of the largest ones of the coins, causing that a range of movement of the actuator (in the dispensing direction0 is larger than a diameter of the coin. In order for the pusher to only push against the lowest coin in the tube, a height of the pusher from the plane of the base plate, i.e. a height extending above the plane of the base plate, is less than a thickness of the coins, preferably less than a thinnest of the coins, so as to be suitable for each of the coin denominations In an even more efficient solution, the rotatable part is arranged between two adjacent coin tubes and configured to rotate bi-directionally so as to form the actuator for either one of the adjacent coin tubes by rotating in the direction of the respective one of the coin tubes. In this situation, a distance between two adjacent coin tubes will be substantially the same as twice the radius of the pin of the rotatable part in respect of the axis of rotation.

Alternatively, the actuators may be linear actuators, such as linear pushers.

In an embodiment, the coin dispenser further comprises brackets each having two resilient arms extending along the dispensing direction and being configured to guide a coin along the trajectory in the coin discharging direction (i.e. the coin dispensing direction). The resilient arms may retain the coins in the dispensing path, even when the actuator would not exactly against a centre trailing edge of the coin, as may be the case with the rotatable actuator.

For example, the brackets are mounted to the coin tubes. Using differently sized coin tubes, e.g. for different coin diameters, a dimensioning of a bracket mounted to the coin tube may be related to an intended coin size for that particular coin tube. Thus, a correct guiding and centering of the coins discharged from that coin tube may be provided in that a dimensioning of the bracket suits an intended coin size. The coin tubes may for example be interchangeable, so as to adapt the coin dispenser to various coin denominations, whereby with the exchange of the coin tube, z suitably sized bracket mounted to it is ensured In an embodiment, seen in top view, the coin tubes are arranged along a circle segment, the dispensing directions being oriented towards a centre of the circle segment, so that the coins of different denominations may all be discharged in a same discharging outlet. Different currencies commonly use different sets of coins, e.g. having different diameters. In order to allow the coin dispenser to be easily adapted to different currencies, in an embodiment, the coin tubes are exchangeable and form a first set of coin tubes, the first set of coin tubes being associated with coins of a first currency, wherein the coin dispenser further comprising a further plurality of coin tubes forming a second set of coin tubes, the further plurality of coin tubes, i.e. the second set of coin tubes, being associated with coins of a second currency. Hence, exchanging the coin tubes from first set to second set allows to adapt the dispenser from the first currency into the second currency. No further changes in the dispenser may be needed, as, according the invention, the dispensing edges and pushers (actuators) are able to provide a same or similar behaviour for all coin diameters in the diameter range.

According to another aspect of the invention, there is provided a coin handler comprising: a coin dispenser according to the invention, and a coin sorting device configured to sort the coins into the coin tubes of the coin dispenser In an embodiment, the coin sorting device comprises:

- a coin feeder configured for providing a serial feeding of coins
- a stationary coin track configured for guiding the coins that are fed by the coin feeder in a direction of propagation along the coin track,
- a plurality of coin discharging openings provided along a length of the coin track, the coin discharging openings to discharge from the coin track a subset of the coins that fit the respective coin discharging opening, wherein the coin discharging openings are arranged from smallest to largest as seen in a direction of propagation of the coins along the coin track in order to allow the subset of coins fitting the coin discharging opening to pass through the coin discharging opening and remaining coins to propagate to a next coin discharging opening along the coin track, wherein the coin track extends along a curve as seen in a horizontal plane thereby causing the direction of propagation along the coin track to curve, wherein the coin track comprises a coin guiding surface along which at least part of a face of the coins propagates, the coin discharging openings being provided in the coin guiding surface, the coin guiding surface having an upward slope in a radially outward direction of the curve of the coin track, wherein the coin tubes of the coin dispenser are positioned at a discharging side of the respective coin discharging openings of the coin sorter to collect coins of a same coin denomination discharged by the coin discharging openings of the coin sorter, in the coin tubes of the coin dispenser.

A highly compact coin handler may be provided that on the one hand provides for a reliable sorting by the coin sorting device, as explained in more detail below, and on the other hand provides for a reliable dispensing by the coin dispenser as has been described above. In an embodiment, the coin dispensing edges of the coin dispenser are arranged along a curve and face towards a centre of the curve, the centre of the curve being, seen in the horizontal plane, concentric with a centre of the curve along which the coin track of the coin sorter extends. The coin tubes are arranged along a circle segment. The dispensing edges are arranged facing towards a centre of the circle segment. As a result, a highly compact assembly may be provided that provides for reliable coin sorting into the coin tubes and reliable coin dispensing from the coin tubes as explained above.

The coin sorting device (of the coin handler) and its embodiments are further described below.

A coin feeder feeds coins to a beginning of the coin track. The coins as fed by the coin feeder propagate (in an embodiment, the coins roll, however in other embodiments, the coins may slide or both roll and slide). along at least a part of the coin track on their own motion, after having been fed by the coin feeder. The coin track is provided with a plurality of openings which are arranged from smallest to largest along the coin track, i.e. as seen in a direction of the propagation of the coins along the coin track. Thus, when a coin propagates along the coin track, it will follow the coin track as long as the size of the coin is to large for the coin to fit in the opening it passes. When however the coin fits the opening, it will enter through the opening thereby leaving the coin track. As the openings are arranged one after the other along the direction of propagation and from small to large, i.e. in an order of increasing size, coins of increasing size will be sorted as they leave the coin track via c corresponding one of the openings. A corresponding discharging duct that discharges into a corresponding container or exit duct may connect to each opening, thereby enabling a sorting of the coins in accordance with their size. The feeder feeds the coins to the coin track, thus moves the coins, causing the coins to propagate along the coin track, thus the coin track being substantially stationary. The coins may be collected in respective coin sorting containers, such as coin collecting tubes.

The coin track extends in a form of a curve (such as a circle segment) which curves as seen in top view i.e. around an axis of curvature that extends in a substantially vertical direction. As a result of the curvature, the coin that propagates along the coin track is subjected to a centripetal force (i.e. a force towards a center of curvature) so as to make the coin follow the curvature. The centripetal force is exerted onto the coin by a coin guiding surface of the coin track while the coin propagates along (such as slides over or rolls along) the coin guiding surface of the coin track. The openings are provided in the coin guiding surface. Given the curvature of the coin track, as soon as the opening has a dimension large enough for the coin to pass through the opening, the coin will lose its hold by the coin guiding surface, as the opening in the coin guiding surface is too large for that particular coin. As a result, the coin guiding surface will not be able to exert the centripetal force onto the coin any more to make the coin follow the curve, causing the coin to leave the coin track through the opening by its centrifugal force. Thus, due to the curvature, the coin will quickly and reliably leave the coin track as soon as it fits into the opening as the centrifugal force on the coin will promote the coin to discharge through the coin discharging opening.

A size of the coin sorter may hence be made smaller, as compared to a prior art coin sorter, in that on the one hand the coin track is curved which shortens its overall dimension. The fact that the centrifugal force causes the coins to pass through the appropriate discharging opening, allows the coin discharging openings to be made less wide (as seen in a direction of propagation of the coins along the coin track), hence providing for a further reduction in overall dimensions. At the same time, a reliability of the coin sorter may increase, as a risk of the coin inadvertently passing its appropriate discharging opening may be smaller due to the coin being forced through the discharging opening by its centrifugal force.

The coin guiding surface of the coin track may extend in vertical direction (i.e. seen in a direction perpendicular to the direction of propagation, i.e. in a direction perpendicular to the curvature of the coin track. Thereby, when the coin fits into the opening, a centrifugal force drives to coin out of the coin track through the opening.

An even larger force to drive the coin through the opening may be achieved when the coin guiding surface having an upward slope in an outward direction of the curve of the coin track. As a result, the coin leans on the coin guiding surface of coin track. As a result, in case the opening in the coin guiding surface is sufficiently large for the coin to leave the coin guiding track via the opening, an additional force, namely a gravity force on the leaning coin, pulls the coin into the opening. Thus, both centrifugal force on the coin as well as gravity force on the coin provide the coin to leave the coin track via the opening. Thus, a reliability of the coin sorter may be increased, as a risk of the coin propagating (sliding, rolling) past the opening inadvertently, and thus being sorted into a next one of the openings, is reduced thereby. In an embodiment, 8 coin discharging openings are provided along a length of the coin track, allowing to sort 8 differently sized coins, In an embodiment, the coin discharging openings are arranged along a sector of the coin track that extends less than 360 degrees, preferably 180 degrees, more preferably less than 90 degrees of an imaginary circle along which the curve of the coin track extends in the horizontal plane allowing to provide a coin sorter having compact overall dimensions as the coin track may in part curve around the coin feeder. In particular with less than 90 degrees (ant to some extent less than 180 degrees) a small overall size may be achieved thus providing compact dimensions. It will be understood that for larger numbers of different coins, a longer coin track may correspondingly be required. Other embodiments are possible, for example, the coin track may have a spiral shape as seen in a horizontal plane.

In an embodiment of the coin sorting device, the coin discharging openings form (e.g. rectangular) slots arranged one behind the other in a direction of movement of the coins along the track. The slots may be rectangular, oval or have any other suitable shape. In an embodiment, a width of the coin discharging openings (as seen in the direction of propagation of the coins along the coin track) is larger than a diameter of the coins that are to pass through the coin discharging opening, preferably is less than 2 times a diameter of the coins that are to pass through the coin discharging opening, more preferably 1.5 times a diameter of the coins that are to pass through the coin discharging opening. Other widths (larger or smaller) are possible too. Choosing a width of less than about 2 times a diameter of the coins that are to pass through the coin discharging opening, a compact coin track may be provided while at the same time offering a high reliability of sorting.

In an embodiment of the coin sorting device, the coin tracks comprises a rail defining a lower edge of the coin track. The rail may be configured to support a circumferential edge of the coins that propagate along the coin track, allowing the coin to roll resp. slide over the rail. As a lower edge of the coin is supported, a defined, reproducible positioning of the coin may be provided, allowing a reproducible sorting. In particular, seen along the direction of propagation of the coin along the coin track, the respective lower edges of the openings extends towards the rail thus providing a minimum resistance to the coin in case the coin fits the opening and should leave the coin track via the opening.

In an embodiment of the coin sorting device, an angle of the slope of the coin guiding surface in the radially outward direction is at least 20 degrees in respect of vertical, preferably between 25 and 35 degrees, more preferably 30 degrees. An angle of the slope of the coin guiding surface in the radially outward direction of approximately 30 degrees in respect of the vertical provides for reliable results, as it provides for an addition of a centrifugal force by the curve and a relatively gravity force by the outward inclining slope of the coin guiding surface, On the other hand, as an angle of approximately 30 degrees in respect of the vertical, an effect of friction of the coin guiding surface is relatively low, thereby providing for an optimum in the range of 25-35, preferably 30 degrees.

In an embodiment of the coin sorting device, the coin track descends along its length, i.e. along a direction of propagation of the coins along the coin track. Thereby, a substantially constant velocity of the coins propagating along the track may be provided, as a gravity force may tend to increase a velocity thereby compensating for a friction of the coin along the coin track that may tend to reduce a velocity along the track. In an embodiment, a descending slope of the coin track is between 25 and 35 degrees, preferably 30 degrees in respect of the horizontal.

In an embodiment of the coin sorting device, the coin track is provided with a metal coating. Hence, a low rolling friction and sliding friction may be provided, providing a low friction, high wear resistance and high cost effective manufacturing.

In an embodiment of the coin sorting device, the coin sorting device further comprises separators arranged behind an edge between neighboring coin discharging openings, the separators being configured to guide the coin that has passed through one of the coin discharging openings to a respective coin sorting container, the separators being offset downstream in respect of the edge between the coin discharging openings, seen in a direction of propagation of the coins along the coin track. The offset may prevent that a coin which passes through the coin discharging opening and collides against the separator, bounces back towards the coin guiding track. The separators may be formed by vertical separation walls.

The coin dispenser according to the invention may be used for dispensing coins. The coin handler according to the invention may be used for sorting and dispensing coins.

Further features, advantages and effects of the coin dispenser according to the invention will follow from the appended drawing, showing a non-limiting embodiment of the invention, wherein.

Figure 5A:
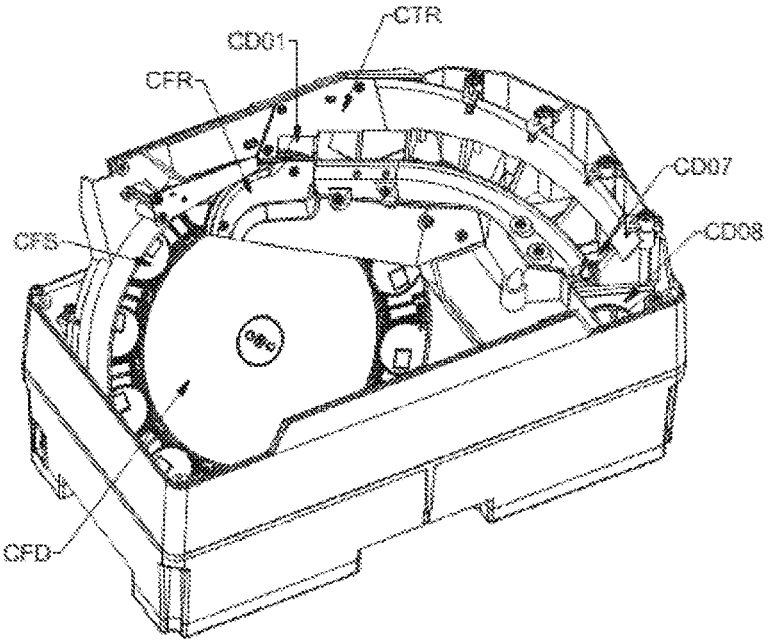
Figure 5B:
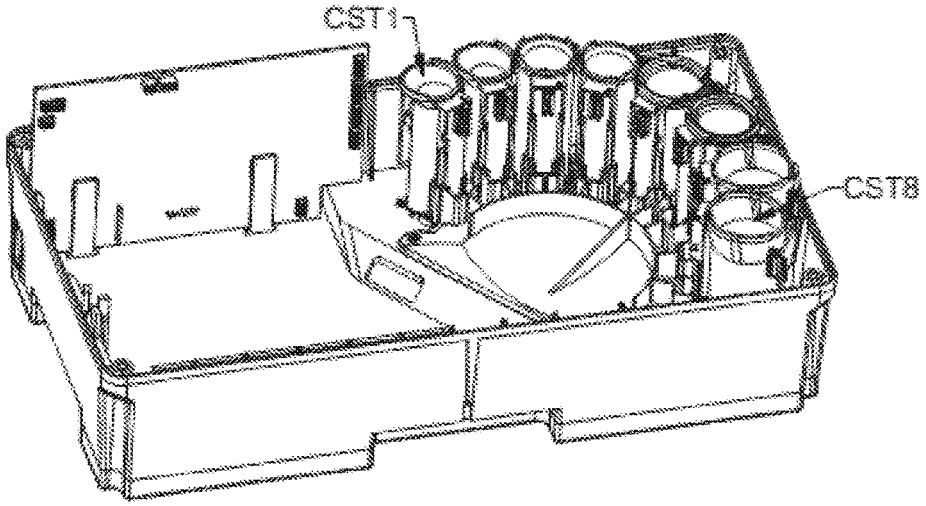
Figure 6:
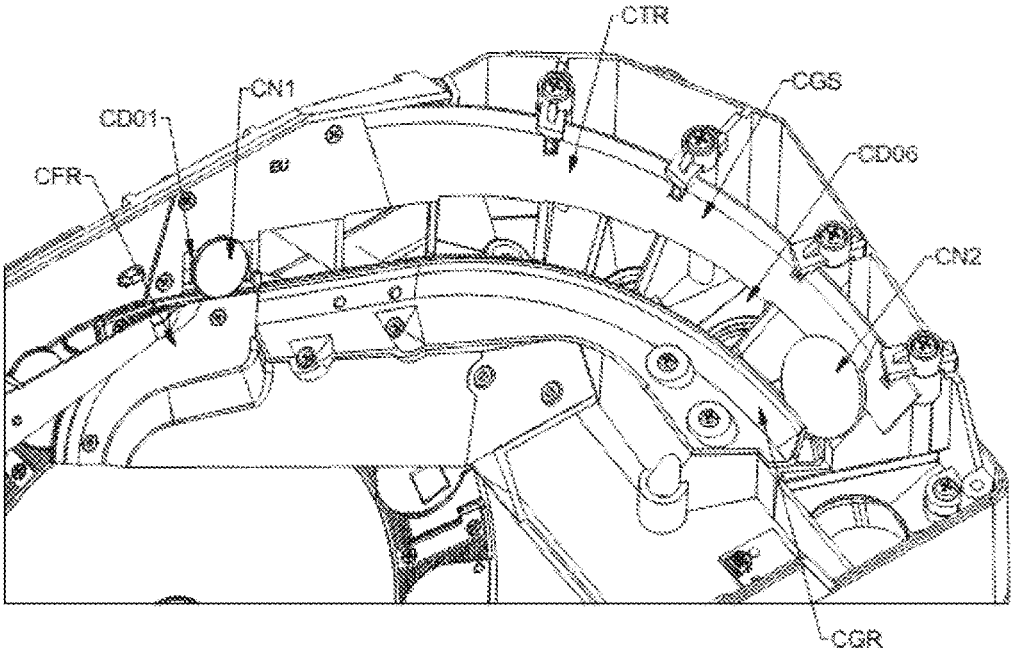
Figure 7:
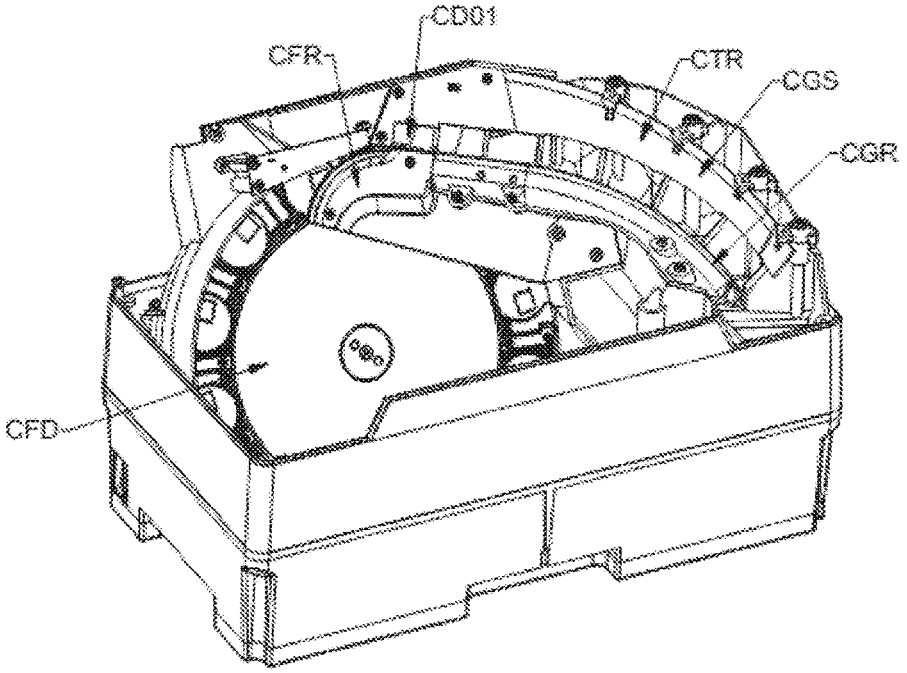
Figure 8:
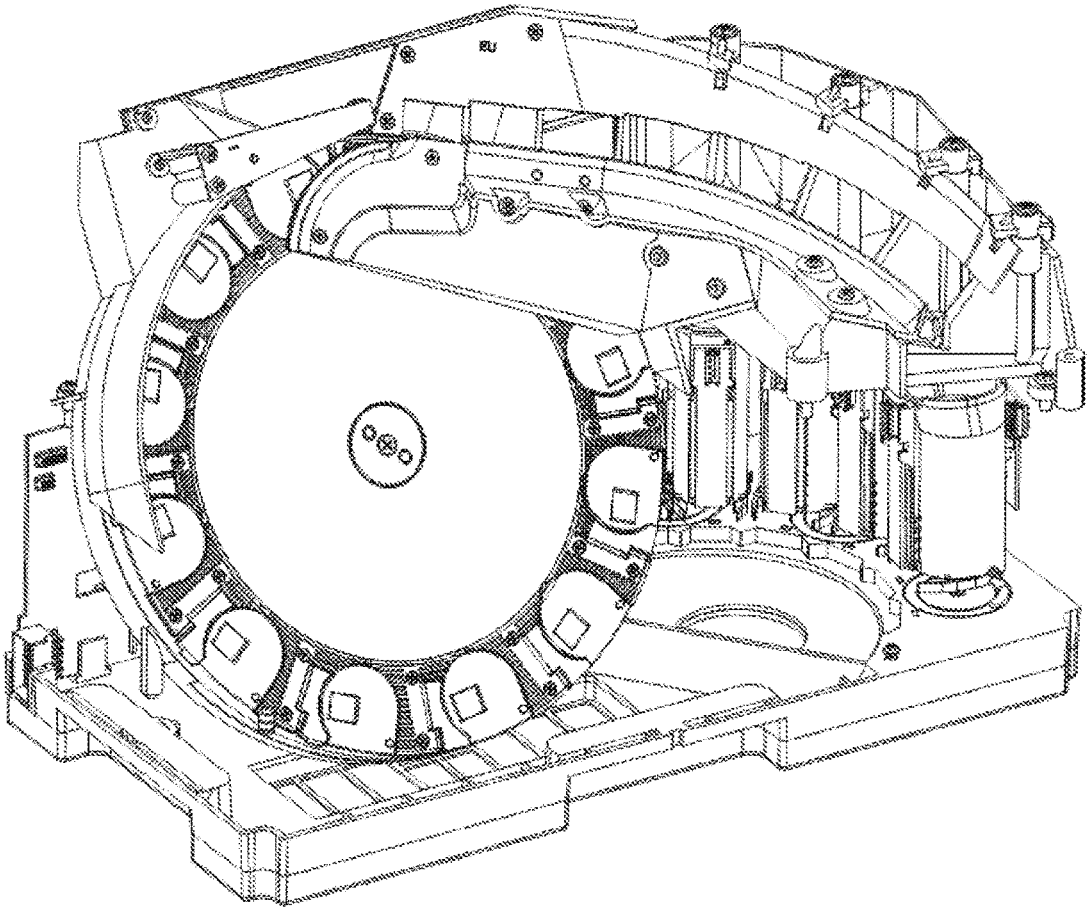

FIGS. 5A, and 5B depict perspective views of parts of a coin sorter (i.e. coin sorting device) according to an aspect of the invention;

FIG. 6 depicts a perspective view of a detail of the coin sorter in accordance to FIG. 5A-5B;

FIG. 7 depicts another perspective view of the coin sorter in accordance to FIG. 5A-5B; and FIG. 8 depicts a coin handler according to an embodiment of the invention comprising the coin dispenser according to FIGS. 1-4 and the coin sorting device according to FIGS. 5A-7.

It is noted that throughout the figures, the same reference numerals refer to the same or similar elements, except where noted otherwise.

Figure 1:
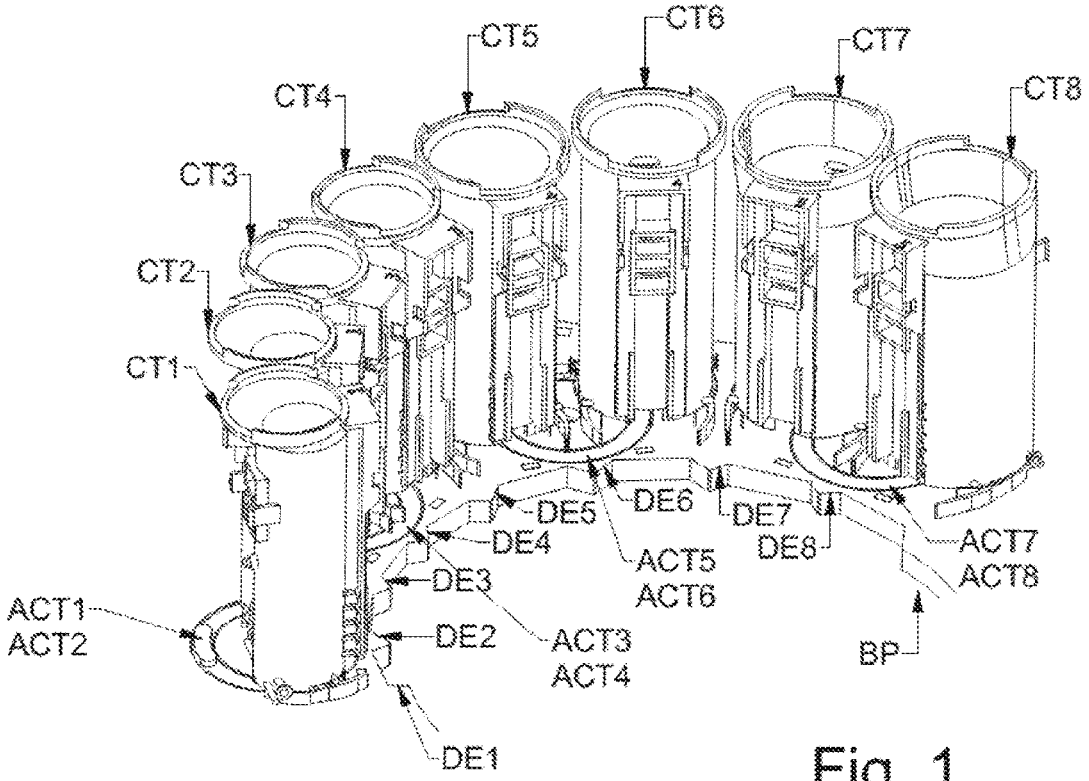
FIG. 1 depicts a perspective view of the coin dispenser according to an embodiment of the invention.

FIG. 1 depicts a schematic perspective view of a coin dispenser according to an embodiment of the invention. The coin dispenser comprises plural coin tubes, in the present example 6 coin tubes, identified as CT1 . . . CT6. The coin tubes are each configured for holding a particular coin denomination. The coin tubes thereby each being configured to hold a vertically stacked plurality of coins. As the coin denominations are mostly associated with different coin diameters, the coin tubes may each be provided with a different inner diameter. The coin tubes may be circumferentially closed or partly open or transparent, so as to allow a more easy inspection of the quantity of coins in the particular tube. A base plate is provided which, amongst others, forms a support for holding the stacks of coins in the coin tubes, the base plate thus forming a bottom plate of the coin tubes. Each coin tube is provided with a discharging opening on at a lower end of the coin tube, i.e. near the base plate, to allow a lowest one of the coins of the stack of coins to be removed from the stack for dispensing. The discharging opening may be formed by a slit in the coin tube. Alternatively, a circumferential slit may be provided between the circumference of the coin tube and the base plate (allowing more easy access by an actuator as explained in more detail below). Each coin tube is associated with a dispensing edge DE, thus in the present example providing dispensing edges DE1 . . . DE6. The dispensing edges each form an edge of the base plate BP. An actuator ACT is associated with each coin tube, in order to move the lowest coin in the stack of coins from the coin tube to the associated dispensing edge DE. Accordingly, the actuators ACT1 . . . ACT 6 are provided. The actuator will be discussed in more detail below with reference to FIG. 3. The actuators ACT1 . . . ACT6 may be controlled by a controller, such as a microcontroller or other programmable device, in order to operate an actuator as needed. Thus, when a coin of a particular denomination is to be dispensed, the respective actuator is operated in order to move the lowest one of the coins of the stack of coins of the particular denomination, to the associated dispensing edge. As depicted in FIG. 1, in the present example, the coin tubes are arranged along a (semi) circle, whereby the discharging directions of the coin tubes face towards a centre of the (semi) circle. As a result, the dispensing edges face each other. In an embodiment, as depicted in FIG. 1, the dispensing edges all discharge into a same discharging duct leading to e.g. a coin dispensing tray where a person can collect the coins that have been dispensed.

Figure 2A:
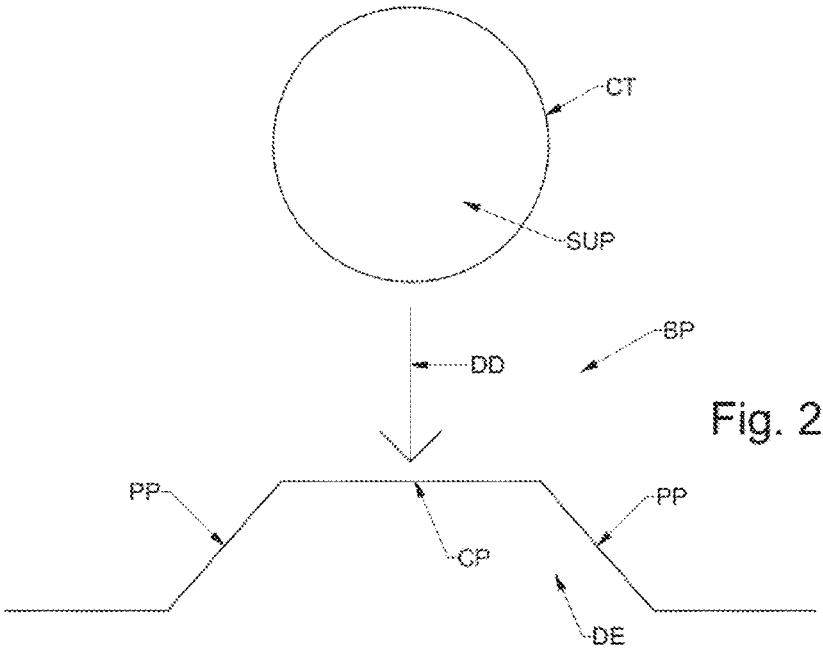
FIG. 2A-2C depict a schematic, detailed views of a part of the coin dispenser in accordance with FIG. 1, FIG. 3A-3D depict a schematic detailed view of another part of the coin dispenser in accordance with FIG. 1.

FIG. 2A depicts a highly schematic top view of a part of the base plate BP and the dispensing edge DE of the coin dispenser in accordance with FIG. 1 As described above, the coins may have different denominations, each associated with a particular coin diameter. The inventors have devised a coin dispensing edge that provides for a similar falling behaviour of coins of different diameter, as follows. The coin dispensing edge is formed by a centre part CP and peripheral parts PP. The centre part CP of the dispensing edge extends perpendicular to the dispensing direction DD and has a width W1 maximally equal to the smallest coin diameter. The peripheral parts PP of the dispensing edge extend from the ends of the centre part and extend at 45 degrees in respect of the dispensing direction DD in which the coins are dispensed from the coin tube to the dispensing edge DE. The peripheral parts of the dispensing edge diverge, as seen in the dispensing direction, causing a width of an opening between the dispensing edges (seen in the direction perpendicular to the dispensing direction) to increase along the dispensing direction towards a width W2. Thus, the peripheral parts of the dispensing edge extend at 90 degrees in respect of each other. A coin which is dispensed, is pushed by the actuator over the base plate in the dispensing direction towards the dispensing edge.

Figure 2B:
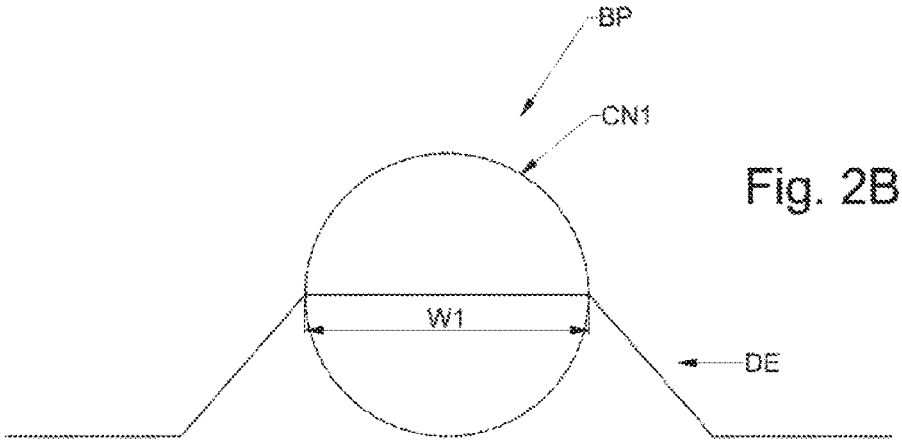

FIG. 2B depicts a coin CN1 having a smallest diameter which is moved from the support area at the lowest position of the stack of coins in the coin tube, to the dispensing edge DE. Given the small diameter of the coin, the coin will be dispensed, i.e. fall over the dispensing edge, when moved to the position as depicted in FIG. 2B. In this position, the coin has reached an equilibrium where half of the coin extends over the dispensing edge, and half of the coin is supported by the base plate BP. In the present example, the diameter of coin CN1 equals the width W1 of the centre edge part.

Figure 2C:
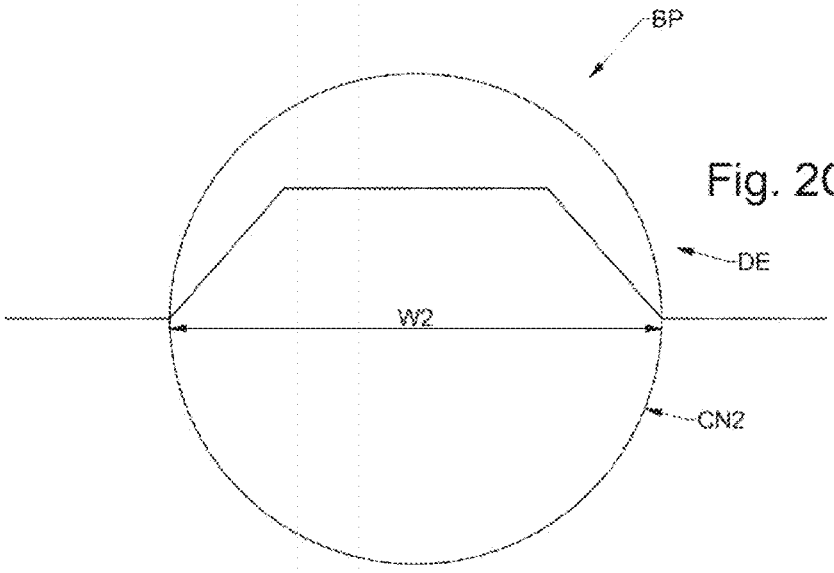

Similarly to FIG. 2B, FIG. 2C depicts the situation where a coin CN2 having a largest coin diameter is moved from the support area at the lowest position of the stack of coins in the coin tube, to the dispensing edge. The coin will be dispensed when moved to the position as depicted in FIG. 2C. At this position half of the coin (the left half seen in the plane f the drawing) is supported by the dispensing edges (in particular by the peripheral parts of the dispensing edges). In the present example, the diameter of coin CN2 equals the maximum width W2 between the peripheral edge parts.

As will follow from FIGS. 2B and 2C, the position of the trailing edge of the smallest coin and the trailing edge of the largest coin is the same, at the moment when the coins tend to fall over the dispensing edge. Thus, in the case where the actuator pushes against the trailing edge of the coin, the position of the actuator when the coin is dispensed, i.e. falls over the dispensing edge, is the same, irrespective of coin diameter. Thus, a same shape of dispensing edge and a same actuator may be applied, irrespective of coin diameter, i.e. irrespective of coin denomination. As a result the actuator as well as the coin dispensing edge of the coin tubes may be dimensioned substantially the same.

Figure 3A:
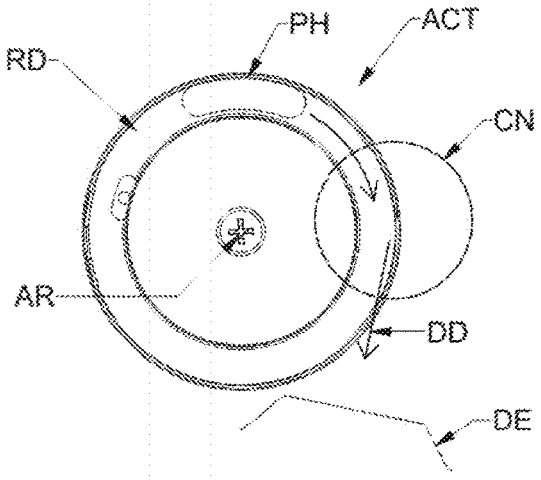

FIG. 3A depicts an embodiment of an actuator ACT, in the present case having a rotatable part. The actuator comprises a rotatable disc RD which is arranged in a plane of the base plate BP, i.e. is flush with the base plate. The rotatable disc may for example be arranged in a recess or an opening of the base plate. On the rotatable disc, a pusher PH is provided which extends in vertical direction from the rotatable disc. The pusher is mounted a-centric in respect of an axis of rotation AR of the rotatable disc. A trajectory of the pusher of the rotatable disc reaches from (a trailing edge of) the lowest coin in the stack of coins in the coin tube, in a discharging direction DD towards the dispensing edge DE.

Figure 3B:
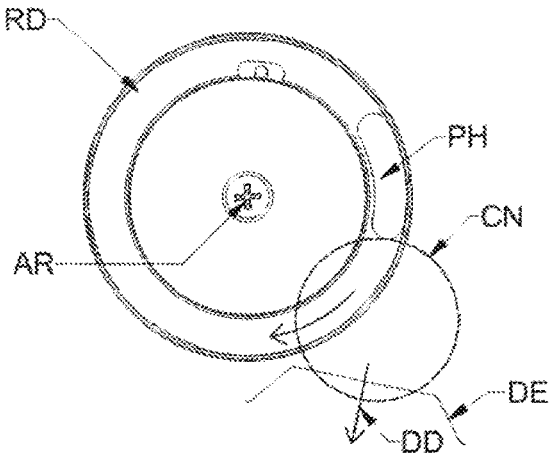
Figure 3C:
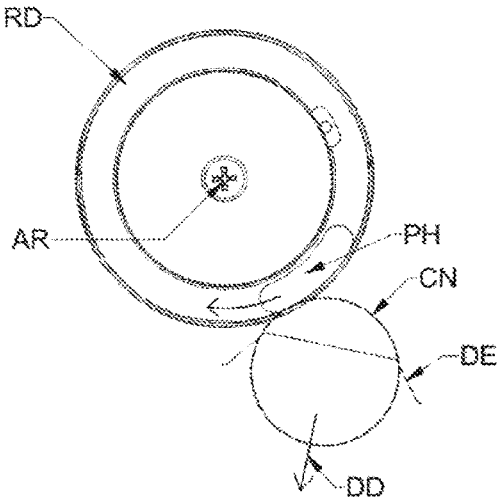

As the rotatable actuator rotates from the position shown in FIG. 3A via the position shown in FIG. 3B to the position shown in FIG. 3C, the lowest coin CN in the stack will move from the stack to the dispensing edge for being discharged over the dispensing edge.

Figure 3D:
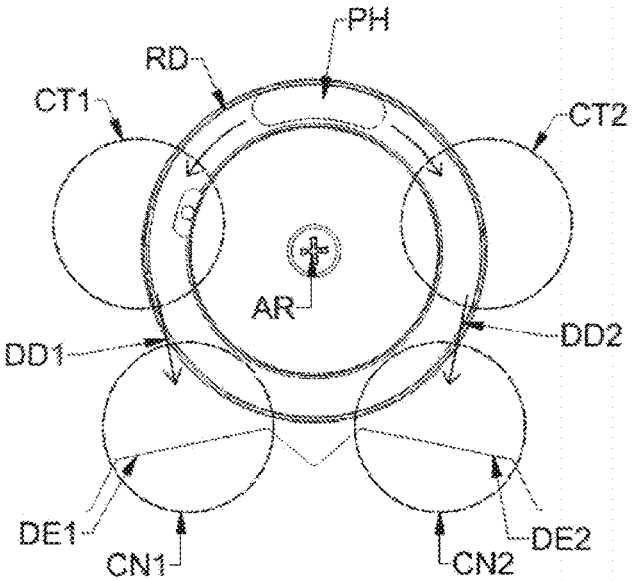

As already schematically indicated in FIG. 1, as depicted in more detail in FIG. 3D, the actuators ACT, in particular when rotatable, may be arranged between two adjacent coin tubes CT1, CT2, e.g. between the discharging paths from the coin tubes to the respective dispensing edges DE1, DE2. Hence, the actuator may serve as an actuator for both the coin tubes CT1, CT2. When rotating the actuator ACT from the position as depicted in FIG. 3D in counter clockwise direction, the coin CN1 will be discharged from coin tube CT1 at the dispensing edge DE1, while, when rotating the actuator ACT from the position as depicted in FIG. 3D in clockwise direction, the coin CN2 will be discharged from coin tube CT2 at dispensing edge DE2. Hence, a single actuator may be applied to dispense from two coin tubes.

Figure 4:
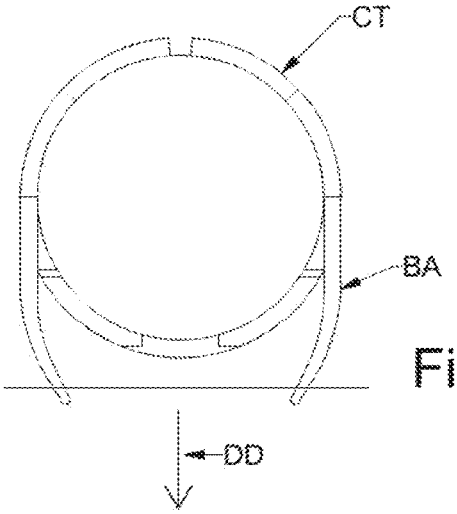
FIG. 4 depicts a schematic detailed view of yet another part of the coin dispenser in accordance with FIG. 1.

In order to prevent the coins from leaving the discharging path as defined by the discharging direction, as depicted in FIG. 4, a resilient bracket BA may be provided, the resilient bracket comprising arms that extend on either side of the discharging path, i.e. in the discharging direction DD so as to guide a coin, when pushed by the actuator, along the discharging direction. The brackets may be mounted to the coin discharge tubes to match a diameter of a coin to be dispensed by that particular tube.

FIG. 5A depicts a perspective view of a coin sorting device according to an aspect of the invention. The coin sorting device comprises a lid LD that has been opened. The coin sorting device comprises a coin feeder (at CFD, as will be explained below in more detail with reference to FIG. 7) that feeds coins, such as in the present example a rotatable coin feeding disc that may be provided with coin feeding sections CFS that are each arranged to hold a coin. The coin feeding disc is positioned in an inclined or vertical position. At a top side of the coin sorting disc, the coins leave the feeder. Thereto, a coin feeding rail CFR lifts the coin from the coin feeder, in this embodiment at the top of the coin feeder, causing the coins to be discharged from the feeder onto a start of the coin track CTR. An excess supply of coins is returned by the feeder into a reservoir from which the coins are fed. In the embodiment as depicted, the coin feeder is formed by a coin feeding disc which is positioned in an included position to feed coins upward towards a beginning of the coin track CTR. The coin feeder is provided with a profiled surface forming recesses to each hold a coin and transport it to the beginning of the coin track. As the beginning of the coin track is near a top of the coin feeding disc, coins having passed the top will either fall out of the recesses by an effect of gravity, or a leaving of the recess may be promoted by respective pins in the recesses that advance when at or near the top so as to provide that the coin moves out of the recess. For illustrative purposes, a top cover that covers the coin feeder and the coin track, has been taken out. The coin track CTR extends from the coin feeding rail, where the coins are discharged from the coin feeder, along a plurality of coin discharging openings CDO . . . CDO8. The coin discharging openings are arranged from smallest to largest size. The coins are sorted by the coin sorter is accordance with their size. A coin set, e.g. a plurality of coins of a particular currency, consists of coins having distinctive sizes. Each of the coin discharging openings CDO are dimensioned to allow coins of a corresponding maximum size to pass through the opening and be discharged from the coin track via that opening. As the coin discharging openings are arranged from smallest at the beginning of the coin track to largest at the end of the coin track, the smallest ones of the coins are discharged via the first one of the openings, while remaining coins pass on along the coin track to respective next ones of the openings. As depicted in FIG. 5A, the coin track curves as seen in a horizontal plane, i.e. as seen from the top side. A centre of curvature is marked in FIG. 5A by CEN.

FIG. 5B depicts a lower sub assembly of the coin sorter, comprising a bottom plate and coin sorting tubes CST1 . . . CST8. The coin sorting tubes are positioned at the respective coin discharging openings to collect coins that have discharged through the respective discharging openings. The sorting tubes have in the present embodiment, each a diameter that matches a corresponding coin diameter of the coins that are sorted into the respective coins tube.

FIG. 6 depicts a detail of the coin sorting device as depicted in FIGS. 5A and 5B. Further to the explanation with reference to FIGS. 5A and 5B above, FIG. 6 depicts two coins CN1 and CN2 that propagate along the coin track CTR. A further coin CN3 is fed by the coin feeder to the start of the coin track. As shown in FIG. 6, the coin track is curved as seen in the horizontal plane. The coins that propagate along the coin track, slide over a coin guiding surface CGS of the coin track. A lower edge of the coins is guided by a rail, i.e. coin guiding rail CGR, that defines a lower edge of the coin guiding track. The rail extends along the coin guiding track. The coin discharging openings, in this example CDO1 . . . CDO6 are provided in the coin guiding surface and are arranged one after the other along the coin guiding track. Depending on a number of different coin sizes to be sorted, a number of coin discharging openings and corresponding number of coin discharging tubes may be adapted. Seen in a propagation direction of the coins along the coin guiding track, the openings are arranged so that their width along the coin guiding surface ranges from smallest to largest, whereby each following opening has a width that is larger than a previous opening. As a result, the effective size of a coin that passes through the opening increases, causing the coins to be sorted from small to large into the respective openings. Each of the coin discharging openings discharges into a respective one of the coin sorting tubes thus sorting the coins in accordance with their size into the coin sorting tubes. In the present embodiment, the coin discharging openings are separated from each other by a vertical partition that extends radially outwardly (as seen in respect of a centre of curvature of the curve of the coin track). The vertical partitions (separators) are arranged somewhat downstream of an edge of the coin discharging openings, as seen in the direction of propagation of the coins along the coin track, thereby to prevent that a coin which passes through the coin discharging opening and collides against the vertical partition, bounces back towards the coin guiding track.

As the coin track curves inwardly, the coins that propagate along the coin track are pushed against a wall of the coin track by their centrifugal force. Thus, when the coin propagates along the coin track, it passes to the next one of the openings when the size of the opening is sufficiently small for the coin to pass the opening, while when the opening is sufficiently large for the coin to discharge, the centrifugal force on the coin as a result of the curve will make the coin to discharge through the coin discharging opening. As a result of the curved coin track, the size of the coin sorter may be reduced. Furthermore, a size of the coin discharging openings, as seen in a direction of propagation of the coins along the coin track, may be held relatively small, as the centrifugal force will provide that the coins discharge relatively quickly through the appropriate coin discharging opening, as a result of the centrifugal force which biases the coin into the opening.

In the present embodiment, the coin guiding surface of the coin guiding track is inclined outwardly, as seen in radial direction in respect of the centre of curvature of the curve of the coin track. As a result of the coin guiding surface being inclined outwardly, the coin when propagating along the coin guiding surface, will leave the coin track via the coin discharging opening as gravity pulls the coin downwardly through the opening. Thus, as a result of the outwardly inclined coin guiding surface, the coins are forced through the opening by an additional force, i.e. gravity, which increases a reliability of the coin passing through the opening when the coin is small enough to do so, thus increasing a reliability of sorting, as a risk of the coin that fits into a respective one of the openings, inadvertently propagating along the track to a next one of the openings, may be reduced by the higher force.

Although FIG. 6 depicts an embodiment wherein the curve of the coin track extends approximately 90 degrees of an imaginary circle, other circle segment lengths of the curve may be provided. It is noted that the openings in the coin track may have a top and bottom edge that extend parallel to the direction of propagation of the coin along the coin track. As a lower edge of the coin is guided by the coin guiding rail, a distance of the coin guiding rail to the upper edge of the opening may define a discriminative size of the opening, in that larger coins pass on to the next opening, while smaller coins are discharged via the opening. The lower edges of the openings may extend towards the rail, so as to provide a low resistance to discharging of coins that should be discharged via the respective con discharging opening. The coin track may descend along its length, which may allow coins that are discharged to retain a substantially constant velocity, as a loss of velocity by rolling of sliding friction may be compensated by the coin descending along the coin track. A slope of an descending angle. In an embodiment, an angle of the slope of the coin guiding surface in respect of the vertical may be 30 degrees. To provide a low sliding resistance and rolling resistance, the coin guiding surface of the coins track and/or the rail may be provided with a coating, FIG. 7 depicts another perspective view of the coin sorter as depicted and described with reference to FIG. 6. FIG. 7, depicts the coin feeding disc with coin feeding sections CFS that are each arranged to hold a coin. The coin feeding disc is positioned in an inclined or vertical position. At a top side of the coin sorting disc, the coins leave the feeder. Thereto, a coin feeding rail CFR lifts the coin from the coin feeder, in this embodiment at the top of the coin feeder, causing the coins to be discharged from the feeder onto a start of the coin track CTR. An excess supply of coins is returned by the feeder into a reservoir from which the coins are fed. The coin feeding disc takes the coins from a coin reservoir at a bottom side of the coin feeding disc, the lower side of the coin feeding disc extending into the reservoir, so as to pick up coins from the reservoir. Excess coins are discharged back into the reservoir.

Combining the coin dispenser as explained with reference to FIGS. 1-4 with the coin sorting device (i.e. coin sorter) as explained with reference to FIGS. 5-7 provides the coin handler as depicted in FIG. 8. The coin sorting tubes CST1 . . . etc. of the coin sorting device thereby form the coin tubes CT1 . . . etc. of the coin dispenser, hence providing a highly compact assembly providing sorting and dispensing of various coin denominations. As depicted, the coin track extends along a (e.g. circular) curve. The coin tubes are arranged along a same or similar curve. The coin dispensing edges DE are arranged at an edge of the base plate below the coin tubes, the coin dispensing edges follow a curve, likewise to the coin tubes. Seen in a horizontal plane, the curves may be concentric. Thus, a coin following the coin track CTR is discharged via a suitably sized coin discharging opening CDO into a coin sorting tube CST of the coin sorting device which forms the coin tube CT of the coin dispenser, and from there, the actuator of the coin dispenser may dispense a coin by moving it from the coin tube CT to the dispensing edge DE.

The invention claimed is:

1. A coin dispenser for dispensing coins having plural coin diameters, each coin diameter being associated with a coin denomination, the coin diameters ranging from a smallest coin diameter to a largest coin diameter, the coin dispenser comprising:

plural coin tubes, each coin tube being configured to hold a stack of coins having one of the plural coin diameters, a base plate arranged under the coin tubes, the base plate having a top surface that defines a plane, the top surface forming support area's for supporting the stacks of coins held by the coin tubes, the base plate having dispensing edges, each dispensing edge forming an edge of the base plate, each dispensing edge being associated with a respective coin tube and being spaced apart, in a respective dispensing direction, from the support area of that coin tube, and a plurality of actuators, each actuator being associated with a respective coin tube and configured to push a coin resting on the support area associated with the respective coin tube in the respective dispensing direction from the support area to and over the dispensing edge associated with the respective coin tube, wherein the dispensing edges each comprise a centre edge part and two peripheral edge parts, the centre edge parts extending along the plane of the base plate in a direction perpendicular to the respective dispensing direction over a width equal to or less than the smallest coin diameter, the peripheral edge parts extending along the plane of the base plate, the peripheral edge parts diverging in the dispensing direction whereby a width between the peripheral edge parts perpendicular to the dispensing direction increases, as seen in the dispensing direction, from a width equal to or less than the smallest coin diameter at the centre edge part to a width equal to or larger than the largest coin diameter, wherein, seen in top view, the coin tubes are arranged along a circle segment, the dispensing directions being oriented towards a centre of the circle segment.

2. The coin dispenser according to claim 1, wherein each actuator is configured to move a respective one of the coins along a trajectory in the dispensing direction, a length of the trajectory of each actuator being the same, for each coin diameter.

3. The coin dispenser according to claim 1 wherein a dimensioning of all dispensing edges is the same, irrespective of the associated coin diameter.

4. The coin dispenser according to claim 1, wherein the width along which the centre edge part extends in the direction perpendicular to the dispensing direction equals the smallest coin diameter and the maximum width between the peripheral edge parts in the direction perpendicular to the dispensing direction equals the largest coin diameter.

5. The coin dispenser according to claim 1, wherein the peripheral edge parts extend under an angle of 35-55 degrees, preferably 40-50 degrees, more preferably 45 degrees in respect of the dispensing direction.

6. A coin dispenser according to claim 1, wherein the coin tubes are exchangeable and being associated with coins of a first currency, the coin dispenser further comprising a further plurality of coin tubes, the further plurality of coin tubes being associated with coins of a second currency.

7. In a method for dispensing coins using a coin dispenser, the improvement wherein the coin dispenser is the coin dispenser according to claim 1.

8. A coin dispenser for dispensing coins having plural coin diameters, each coin diameter being associated with a coin denomination, the coin diameters ranging from a smallest coin diameter to a largest coin diameter, the coin dispenser comprising:

plural coin tubes, each coin tube being configured to hold a stack of coins having one of the plural coin diameters, a base plate arranged under the coin tubes, the base plate having a top surface that defines a plane, the top surface forming support area's for supporting the stacks of coins held by the coin tubes, the base plate having dispensing edges, each dispensing edge forming an edge of the base plate, each dispensing edge being associated with a respective coin tube and being spaced apart, in a respective dispensing direction, from the support area of that coin tube, and a plurality of actuators, each actuator being associated with a respective coin tube and configured to push a coin resting on the support area associated with the respective coin tube in the respective dispensing direction from the support area to and over the dispensing edge associated with the respective coin tube, wherein the dispensing edges each comprise a centre edge part and two peripheral edge parts, the centre edge parts extending along the plane of the base plate in a direction perpendicular to the respective dispensing direction over a width equal to or less than the smallest coin diameter, the peripheral edge parts extending along the plane of the base plate, the peripheral edge parts diverging in the dispensing direction whereby a width between the peripheral edge parts perpendicular to the dispensing direction increases, as seen in the dispensing direction, from a width equal to or less than the smallest coin diameter at the centre edge part to a width equal to or larger than the largest coin diameter, wherein the actuator comprises a rotatable part which is rotatable about an axis perpendicular to the plane of the base plate, the rotatable part comprising an arm and a pusher connected to the arm and extending in vertical direction from the plane of the base plate, a rotation of the rotatable part causing the pusher to push against the coin resting on the support area associated with the respective coin tube, wherein the rotatable part is arranged between two adjacent coin tubes and configured to rotate bi-directionally so as to form the actuator for either one of the adjacent coin tubes by rotating in the direction of the respective one of the coin tubes.

9. The coin dispenser according to claim 8, wherein a height of the pusher from the plane of the base plate is less than a thickness of a thinnest one of the coins.

10. A coin dispenser for dispensing coins having plural coin diameters, each coin diameter being associated with a coin denomination, the coin diameters ranging from a smallest coin diameter to a largest coin diameter, the coin dispenser comprising:

plural coin tubes, each coin tube being configured to hold a stack of coins having one of the plural coin diameters, a base plate arranged under the coin tubes, the base plate having a top surface that defines a plane, the top surface forming support area's for supporting the stacks of coins held by the coin tubes, the base plate having dispensing edges, each dispensing edge forming an edge of the base plate, each dispensing edge being associated with a respective coin tube and being spaced apart, in a respective dispensing direction, from the support area of that coin tube, and a plurality of actuators, each actuator being associated with a respective coin tube and configured to push a coin resting on the support area associated with the respective coin tube in the respective dispensing direction from the support area to and over the dispensing edge associated with the respective coin tube, wherein the dispensing edges each comprise a centre edge part and two peripheral edge parts, the centre edge parts extending along the plane of the base plate in a direction perpendicular to the respective dispensing direction over a width equal to or less than the smallest coin diameter, the peripheral edge parts extending along the plane of the base plate, the peripheral edge parts diverging in the dispensing direction whereby a width between the peripheral edge parts perpendicular to the dispensing direction increases, as seen in the dispensing direction, from a width equal to or less than the smallest coin diameter at the centre edge part to a width equal to or larger than the largest coin diameter, the coin dispenser further comprising brackets each having two resilient arms extending along the dispensing direction and being configured to guide a coin along the trajectory in the coin dispensing direction.

11. The coin dispenser according to claim 10, wherein the brackets are mounted to the coin tubes.

12. A coin handler comprising:

a coin dispenser for dispensing coins having plural coin diameters, each coin diameter being associated with a coin denomination, the coin diameters ranging from a smallest coin diameter to a largest coin diameter, the coin dispenser comprising:

plural coin tubes, each coin tube being configured to hold a stack of coins having one of the plural coin diameters, a base plate arranged under the coin tubes, the base plate having a top surface that defines a plane, the top surface forming support area's for supporting the stacks of coins held by the coin tubes, the base plate having dispensing edges, each dispensing edge forming an edge of the base plate, each dispensing edge being associated with a respective coin tube and being spaced apart, in a respective dispensing direction, from the support area of that coin tube, and a plurality of actuators, each actuator being associated with a respective coin tube and configured to push a coin resting on the support area associated with the respective coin tube in the respective dispensing direction from the support area to and over the dispensing edge associated with the respective coin tube, wherein the dispensing edges each comprise a centre edge part and two peripheral edge parts, the centre edge parts extending along the plane of the base plate in a direction perpendicular to the respective dispensing direction over a width equal to or less than the smallest coin diameter, the peripheral edge parts extending along the plane of the base plate, the peripheral edge parts diverging in the dispensing direction whereby a width between the peripheral edge parts perpendicular to the dispensing direction increases, as seen in the dispensing direction, from a width equal to or less than the smallest coin diameter at the centre edge part to a width equal to or larger than the largest coin diameter, and wherein the coin handler further comprises a coin sorting device configured to sort the coins into the coin tubes of the coin dispenser, wherein the coin sorting device comprises:

a coin feeder configured for providing a serial feeding of coins a stationary coin track configured for guiding the coins that are fed by the coin feeder in a direction of propagation along the coin track, and a plurality of coin discharging openings provided along a length of the coin track, the coin discharging openings to discharge from the coin track a subset of the coins that fit the respective coin discharging opening, wherein the coin discharging openings are arranged from smallest to largest as seen in a direction of propagation of the coins along the coin track in order to allow the subset of coins fitting the coin discharging opening to pass through the coin discharging opening and remaining coins to propagate to a next coin discharging opening along the coin track, wherein the coin track extends along a curve as seen in a horizontal plane thereby causing the direction of propagation along the coin track to curve, wherein the coin track comprises a coin guiding surface along which at least part of a face of the coins propagates, the coin discharging openings being provided in the coin guiding surface, the coin guiding surface having an upward slope in a radially outward direction of the curve of the coin track, and wherein the coin tubes of the coin dispenser are positioned at a discharging side of the respective coin discharging openings of the coin sorter to collect coins of a same coin denomination discharged by the coin discharging openings of the coin sorter, in the coin tubes of the coin dispenser.

13. The coin handler according to claim 12, wherein the curve along which the coin track extends is a circle segment.

14. The coin handler according to claim 12, wherein the coin dispensing edges of the coin dispenser are arranged along a circle segment and face towards a centre of the circle segment, the centre of the circle segment being, seen in top view, concentric with a centre of the circle segment along which the coin track of the coin sorter extends.

15. In a method for sorting and dispensing coins using a coin handler, the improvement wherein the coin handler is the coin handler according to claim 12.

* * * * *